US008366480B2

(12) United States Patent
Neu et al.

(10) Patent No.: US 8,366,480 B2
(45) **Date of Patent: *Feb. 5, 2013**

(54) ELECTRONIC ACCESSORIES FOR DIGITAL MUSIC PLAYERS AND RELATED METHODS

(75) Inventors: Thorben Neu, Los Angeles, CA (US); Vincent Razo, Granada Hills, CA (US); David A Kleeman, Marina del Rey, CA (US)

(73) Assignee: Belkin International, Inc., Playa Vista, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/491,219

(22) Filed: Jun. 7, 2012

(65) Prior Publication Data

US 2012/0244745 A1 Sep. 27, 2012

Related U.S. Application Data

(63) Continuation of application No. 13/101,884, filed on May 5, 2011, now Pat. No. 8,210,871, which is a continuation of application No. 12/858,328, filed on Aug. 17, 2010, now Pat. No. 7,980,892, which is a continuation of application No. 11/472,111, filed on Jun. 20, 2006, now Pat. No. 7,803,016.

(51) Int. Cl.
*H01R 29/00* (2006.01)

(52) U.S. Cl. ..... 439/569; 439/527; 439/374; 700/94; 700/95

(58) Field of Classification Search ..... 439/569, 439/527, 374; 700/94, 95
See application file for complete search history.

(56) References Cited

U.S. PATENT DOCUMENTS

| | | | |
|---|---|---|---|
| D338,465 | S | 8/1993 | Hayasaka et al. |
| D366,262 | S | 1/1996 | Inaba |
| D369,808 | S | 5/1996 | Hon et al. |
| D415,442 | S | 10/1999 | Ikeda |
| 6,007,228 | A | 12/1999 | Agarwal et al. |
| D419,160 | S | 1/2000 | Davidson et al. |
| D426,223 | S | 6/2000 | Nomura |
| 6,127,802 | A | 10/2000 | Lloyd et al. |
| 6,253,183 | B1 | 6/2001 | Boucard |
| D450,313 | S | 11/2001 | Koinuma |
| 6,483,698 | B1 | 11/2002 | Loh |
| 6,516,202 | B1 | 2/2003 | Hawkins et al. |
| 6,711,005 | B2 | 3/2004 | Martin |
| D488,795 | S | 4/2004 | Christianson |
| 6,793,520 | B1 | 9/2004 | Wu |
| 6,842,356 | B2 | 1/2005 | Hsu |
| D506,209 | S | 6/2005 | Leong |
| D507,261 | S | 7/2005 | Griffin |
| D511,770 | S | 11/2005 | Chung |
| 7,004,794 | B2 | 2/2006 | Wang et al. |
| 7,029,315 | B2 | 4/2006 | Dang |
| D525,616 | S | 7/2006 | Andre et al. |
| D534,149 | S | 12/2006 | Griffin |
| D535,278 | S | 1/2007 | Hussaini et al. |
| D535,972 | S | 1/2007 | Griffin |
| 7,167,372 | B2 | 1/2007 | Mori et al. |
| D551,212 | S | 9/2007 | Andre et al. |

(Continued)

OTHER PUBLICATIONS

Numark Debuts iPod Mixing Console at NAMM; http://namm.harmony-central.com/SNAMM05/Content/Numark/PR/iDJ.html; Jul. 26, 2005; 5 pages.

(Continued)

*Primary Examiner* — Gary F. Paumen
(74) *Attorney, Agent, or Firm* — Bryan Cave LLP

(57) ABSTRACT

Embodiments of electronic accessories for digital music players are disclosed herein. Other examples and related methods are also disclosed herein.

23 Claims, 11 Drawing Sheets

U.S. PATENT DOCUMENTS

| | | | | |
|---|---|---|---|---|
| D551,213 | S | 9/2007 | Andre et al. | |
| 7,269,002 | B1 | 9/2007 | Turner et al. | |
| D552,085 | S | 10/2007 | Andre et al. | |
| D558,738 | S | 1/2008 | Andre et al. | |
| D558,739 | S | 1/2008 | Andre et al. | |
| 7,329,136 | B2 | 2/2008 | Su et al. | |
| 7,329,153 | B2 | 2/2008 | Lin et al. | |
| 7,346,315 | B2 | 3/2008 | Zurek et al. | |
| 7,381,095 | B2 | 6/2008 | Freeman et al. | |
| 7,382,891 | B2 | 6/2008 | Weikel et al. | |
| 7,399,198 | B2 | 7/2008 | Thalheimer et al. | |
| 7,488,215 | B2 | 2/2009 | Mayette et al. | |
| 7,492,890 | B2 | 2/2009 | Milani | |
| 7,566,231 | B2 | 7/2009 | Regen et al. | |
| 7,580,255 | B2 | 8/2009 | Crooijmans et al. | |
| 7,647,129 | B1 | 1/2010 | Griffin | |
| 7,651,368 | B2 | 1/2010 | Kendall et al. | |
| 7,699,664 | B2 | 4/2010 | Kim et al. | |
| 7,719,830 | B2 | 5/2010 | Howarth et al. | |
| 2005/0141885 | A1 | 6/2005 | Roman et al. | |
| 2005/0146996 | A1 | 7/2005 | Roman | |
| 2005/0231642 | A1 | 10/2005 | Roman et al. | |
| 2005/0244025 | A1 | 11/2005 | Schul et al. | |
| 2005/0259532 | A1 | 11/2005 | Roman et al. | |
| 2006/0052144 | A1 | 3/2006 | Seil et al. | |
| 2006/0181840 | A1* | 8/2006 | Cvetko | 361/679 |
| 2006/0221776 | A1 | 10/2006 | Roman et al. | |
| 2006/0251381 | A1 | 11/2006 | Wickstead et al. | |
| 2007/0280489 | A1 | 12/2007 | Roman et al. | |
| 2011/0245947 | A1 | 10/2011 | Morohoshi et al. | |

OTHER PUBLICATIONS

Numark Announces IDJ Mixing Console for Apple iPod; http://www.gearjunkies.com/news_info.php?news_id=731; Jul. 22, 2005; 6 pages.

Numark IDJ Mixing Console for iPod; http://reviews.cnet.com/Numark_iDJ_Mixing_Console_for_iPod/4514-6519_7-31594002.html?a . . . ; Dec. 13, 2005; 4 pages.

Playlist: Belkin Unveils TuneCommand, TuneTalk iPod Accessories; http:/playlistmag.com/news/2005/07/15/belkinipodaccessories/index.php?1src=mwrss; retrieved from the internet on Jul. 15, 2005; 3 pages.

Belkin TuneTalk TMStereo for iPod® video Nabs the iLounge 2006 "Best of Show" Award; http://www.belkin.com/pressroom/releases/uploads/01_24_06iLoungeBestofShow.html, retrieved from the internet on May 15, 2006, 2 pages.

Griffin iTalkPro Stereo Microphone for iPod 5G; http://www.ilounge.com/index.php/ipod/review/griffn-italkpro-stereo-microphone-for-ipo; retrieved from the Internet on May 10, 2006, 10 pages.

* cited by examiner

| Pin | Signal | Description |
|---|---|---|
| 571 | GND | Ground |
| 572 | Right In | Line In-Right |
| 573 | Left In | Line In-Left |
| 574 | GND | Audio Ground |
| 575 | GND | Serial Ground |
| 576 | Tx | Audio receiving system sending line, Serial TxD |
| 577 | Rx | Audio receiving system receiving line, Serial RxD |
| 578 | 3.3v | 3.3 Volt (V) Power |
| 579 | 5 VDC | USB Power direct current voltage (VDC) |
| 580 | Data(-) | USB Data |
| 581 | Data(+) | USB Data |
| 582 | GND | USB Ground |

ELECTRONIC ACCESSORIES FOR DIGITAL MUSIC PLAYERS AND RELATED METHODS

CROSS-REFERENCE TO RELATED APPLICATIONS

This patent application is a continuation of U.S. patent application Ser. No. 13/101,884, filed on May 5, 2011, which is a continuation of U.S. patent application Ser. No. 12/858,328, filed Aug. 17, 2010 (now U.S. Pat. No. 7,980,892), which is a continuation of U.S. patent application Ser. No. 11/472,111, filed on Jun. 20, 2006 (now U.S. Pat. No. 7,803,016). The disclosures of the applications and patents above are incorporated herein by reference.

TECHNICAL FIELD

This invention relates generally to connection systems for electronic devices, and relates more particularly to electronic accessories for MP3 players.

BACKGROUND

MP3 players include digital music players capable of handling digital audio files in one or more file formats. Several formats for digital audio files exist, each offering its own combination of sound quality, compression rate, streaming capability, and other features. Some of the existing file formats are: AAC, ATRAC, MP3, AIFF, WMA, OGG, and WAV, but this list is not an exhaustive one. Portable digital audio players capable of playing digital audio files, and of storing them in large numbers, have become very popular. Such players are often referred to as MP3 players because of the popularity of that particular file format.

Traditionally, MP3 players have only been able to playback audio files upload from a computer and stored in the storage system of the MP3 player in one of aforementioned file formats. Additionally, most MP3 players have not included mechanisms for allowing the recording of music or sounds, nor do they provide support for external audio receiving devices. However, a voice recording mechanism is available for one MP3 player in widespread use, sold under the trademark iPod by Apple Computer, Inc. of Cupertino, Calif. However, this microphone only allows a user to record single channel (mono) audio at 8 KHz (kilohertz) and attaches to the 3.5 mm Tip Ring Sleeve (TRS) connector on the iPod.

Furthermore, the body of the MP3 player can easily be dented or scratched and an LCD screen on the MP3 player cracked during the handling or usage of the device. Therefore, it is common for users to cover their MP3 players with a protective case. Protective cases for MP3 players can be composed of a variety of materials including, for example, leather, hard or soft plastic, rubber, or cloth.

While protective cases can provide protection for MP3 players from scratches and dents, the protective cases can hinder the coupling of external devices to the MP3 player. MP3 players sometimes couple to external devices through a female connector on the bottom or top of the MP3 player. External devices, such as audio receiving systems, are well-suited to couple to an MP3 player inside of a protective case. The material between the MP3 player and the external device can hinder a good electrical coupling between the male connector on the external device and the female connector on MP3 player because the length of the connector on the external device is equal to the length of connector on the MP3 player, not the length of connector plus the thickness of the protective case. The extra distance prevents the two connectors from completely and securely mating. In most cases, the MP3 player must be removed from the protective case before the external device can be used.

Newer models of the iPod and other MP3 players provide increased support for external devices, including devices to record sounds. Accordingly, a need or potential for benefit exists for an external device that is able to provide high quality stereo audio recording capability to MP3 players and a method of coupling the MP3 player to the external device when the MP3 player is enclosed in a protective case. Other needs or potential benefits may be apparent from this disclosure.

BRIEF DESCRIPTION OF THE DRAWINGS

The invention will be better understood from a reading of the following detailed description, taken in conjunction with the accompanying figures in the drawings in which.

Figures 1, 2:
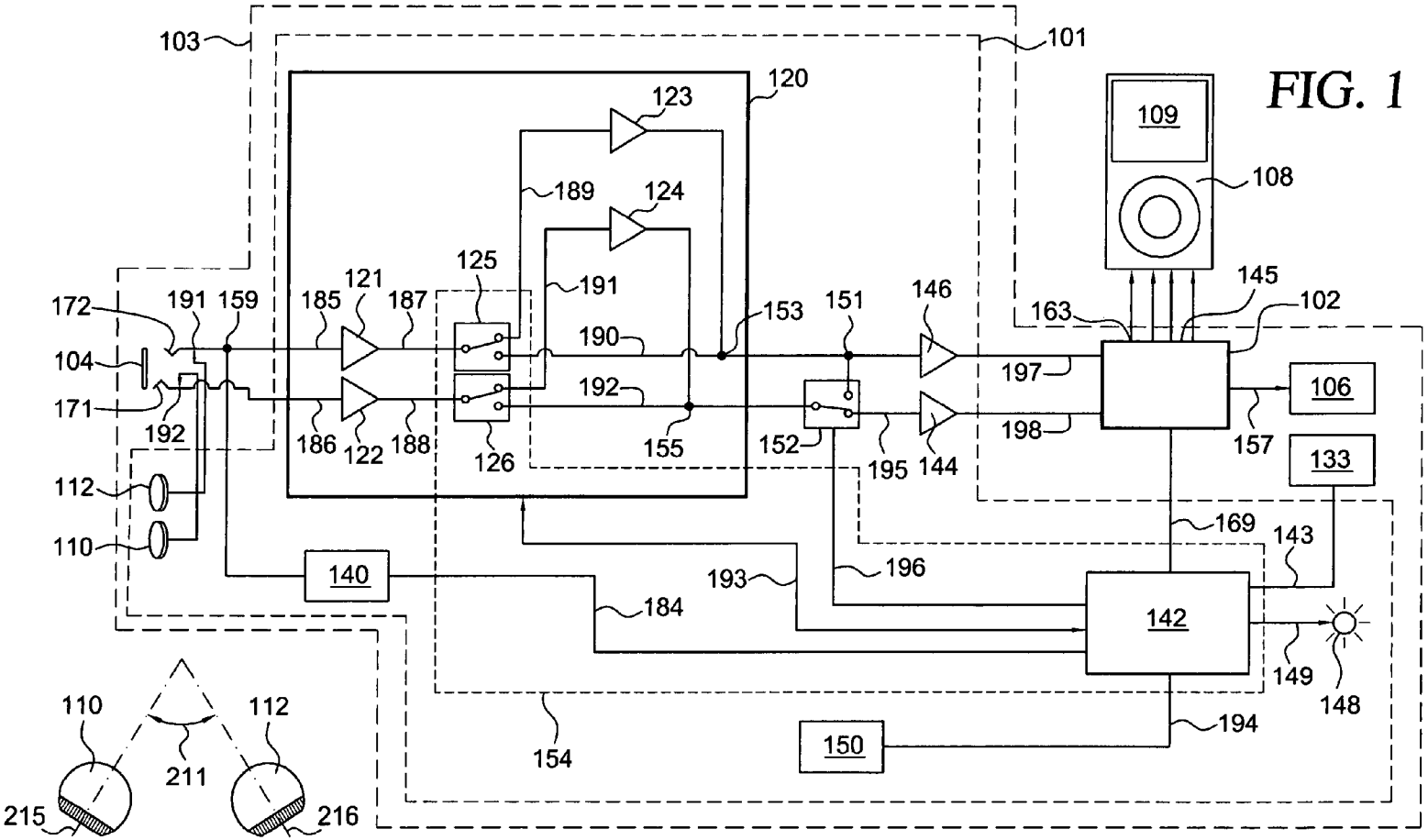
FIG. 1 is a block diagram of an audio receiving system for an MP3 player according to an embodiment of the invention.
FIG. 2 is a diagram illustrating the relative placement of the microphones in the audio receiving system of FIG. 1 according to an embodiment of the invention.

For simplicity and clarity of illustration, the drawing figures illustrate the general manner of construction, and descriptions and details of well-known features and techniques may be omitted to avoid unnecessarily obscuring the invention. Additionally, elements in the drawing figures are not necessarily drawn to scale. For example, the dimensions of some of the elements in the figures may be exaggerated relative to other elements to help improve understanding of embodiments of the present invention. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of the invention described herein are, for example, capable of operation in sequences other than those illustrated or otherwise described herein. Furthermore, the terms "comprise," "include," "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "over," "under," and the like in the description and in the claims, if any, are used for descriptive purposes and not necessarily for describing permanent relative positions. It is to be understood that the terms so used are interchangeable under appropriate circumstances such that the embodiments of the invention described herein are, for example, capable of operation in other orientations than those illustrated or otherwise described herein. The term "coupled," as used herein, is defined as directly or indirectly connected in an electrical, mechanical, or other manner. The term "secured," as used herein, is defined as firmly attaching, joining, fixing, fastening, or connecting one item to another item, in a manner appropriate for the specific items.

DESCRIPTION

In an example of an embodiment of the invention, an audio receiving system for an MP3 player includes: (a) a stereo audio receiving mechanism capable of receiving sounds and converting the sounds into stereo electrical audio signals; and (b) an audio interface electrically coupled to the stereo audio receiving system and configured to be plugged into and electrically coupled to the MP3 player and to enable the MP3 player to record sounds in stereo.

In another embodiment of the invention, a stereo audio receiving system for an MP3 player is formed by the steps of: (a) securing an amplifier to a housing; (b) securing a first microphone to the housing; (c) securing a second microphone to the housing; (d) securing an audio interface to the housing; (e) electrically coupling the first and second microphones to the amplifier; and (f) electrically coupling the audio interface to the amplifier, where the audio interface is configured to be plugged into and electrically coupled to the MP3 player.

In yet another embodiment of the invention, an electronic accessory for an MP3 player includes: (a) a body having a neck extending from the body, the neck having a cross-sectional dimension that is substantially less than a corresponding cross-sectional dimension of the body; (b) an electrical connector located at least partially within the neck and configured to electrically connect the accessory to the MP3 player; (c) one or more electrical components located at least partially within the body; and (d) two or more of electrical conductors electrically coupling the electrical components to the electrical connector.

In a further embodiment of the invention, an electronic accessory capable of coupling to an electronic device includes: (a) a hollow body having a width, a length, and a thickness, and a neck extending from the body, the neck having a length that is substantially less than the length of the body; (b) an electrical interface at least partially located within the neck and configured to electrically connect the electronic accessory to the electronic device; (c) one or more electrical components located at least partially within the hollow body; (d) two or more electrical conductors electrically coupling the electrical components to the electrical connector; and (e) a spacer having an opening sized and shaped to removably fit around the neck of the body.

In a subsequent embodiment of the invention, an electronic accessory capable of providing a stable coupling to an electronic device independent of whether the electronic accessory is housed within a removable protective case, is provided by at least the steps of, in any order: (a) providing an electronic accessory including: (1) a body, (2) a neck extending from the body, (3) an electrical connector located within the neck and configured to electrically connect the electronic accessory to the electronic device, (4) at least one electrical component located at least partially within the body, (5) two or more electrical conductors electrically connecting at least one electrical component to the electrical connector; (b) providing a spacer having an opening wherein the neck will fit at least partially within the opening; and (c) at least one of: instructing a user to omit the spacer if the electronic device is enclosed within a protective case, or instructing a user to include the spacer if the electronic device is not housed within a protective case.

In another embodiment, an electronic accessory for a electronic device comprises a neck, a body coupled to the neck, and an electrical connector located at least partially within the neck. The neck can comprise a neck height, a first neck surface, and a first neck cross-sectional dimension. The body can comprise a first body surface substantially parallel to the first neck surface, and a first body cross-sectional dimension greater than, and substantially parallel to, the first neck cross-sectional dimension. The electrical connector can be configured to couple the electronic accessory to the electronic device through a docking surface of the electronic device at a docking end of the electronic device. When the electrical connector is coupled to the electronic device through the docking surface, the first neck surface and the first body surface can be substantially parallel to the docking surface, the first neck surface can be closer than the first body surface to the docking surface, and the first body surface can be substantially non-concave relative to the docking surface.

In a further embodiment, an electronic accessory configured to couple with an electronic device can comprise a housing and a spacer. The housing can comprise a body comprising a width, a length, and a thickness; and a neck extending from the body, the neck comprising a length less than the length of the body. The spacer can comprise an opening configured to be removably coupled around the neck. When the electronic accessory is fully electrically coupled to the electronic device through a docking end of the electronic device, the neck can be located between the body and the electronic device and the electronic device remains uncradled by the electronic accessory.

In one example, a method for providing an accessory for an electronic device can comprise providing a housing of the accessory, and providing an electrical connector coupled to the housing to electrically couple the accessory to a docking end of the electronic device. Providing the housing can comprises providing a body comprising a body cross-sectional dimension, providing a neck protruding from a body surface of the body and comprising a neck cross-sectional dimension, and providing the body surface to be substantially non-concave with respect to the electronic device when the accessory is coupled to the docking end. Providing the electrical connector can comprise locating the electrical connector at least partially within the neck and protruded from a neck surface of the neck. Providing the neck can comprise providing the neck cross-sectional dimension to be substantially parallel with, and less than, the body cross-sectional dimension, and providing the neck surface to be closer than the body surface to the docking end of the electronic device when the electrical connector is fully seated with the electronic device.

In an additional embodiment, an electronic accessory for a electronic device comprises a neck, a body, and an electrical connector. The neck can comprise a neck height, a first neck surface facing an exterior of the electronic accessory, and a first neck cross-sectional dimension. The body can be coupled to the neck and can comprise (a) a first body surface facing the exterior of the electronic accessory and substantially parallel to the first neck surface, and a (b) first body cross-sectional dimension greater than, and substantially parallel to, the first neck cross-sectional dimension. The electrical connector can be located at least partially within the neck and can be configured to couple the electronic accessory to the electronic device through a docking surface of the electronic device at a docking end of the electronic device. The neck can be coupled to the first body surface in a fixed configuration. When the electrical connector is coupled to the electronic device through the docking surface, the first neck surface and the first body surface can be are substantially parallel to the docking surface, and the first neck surface can be closer than the first body surface to the docking surface. The first body surface can be substantially non-concave relative to an external portion of the electrical connector.

In yet another embodiment, an electronic accessory configured to couple with an electronic device comprises a housing with a body and a neck. The body can comprise a width, a length, a thickness, and an end portion. The neck can be fixedly coupled to and protruding from an exterior surface of the end portion of the body, and can comprise a length less than the length of the body. The neck can remain fully exposed and uncradled by the body, and can remain centered relative to the width and the length of the body. When the electronic accessory is fully electrically coupled to the electronic device through a docking end of the electronic device, the neck can be located between the body and the electronic device, and the electronic device can remain uncradled by the electronic accessory.

In one example, a method for providing an accessory for an electronic device can comprise (1) providing a housing of the accessory, and (2) providing an electrical connector coupled to the housing to electrically couple the accessory to a docking end of the electronic device. Providing the housing can comprises (1) providing a body comprising a body cross-sectional dimension and an external body surface, (2) providing a neck fixedly coupled to and protruding from the external body surface, the neck comprising a neck cross-sectional dimension; and (3) providing the external body surface to be substantially non-concave with respect to the neck. Providing the electrical connector can comprise locating the electrical connector at least partially within the neck and protruded from a neck surface of the neck. Providing the neck can comprise providing the neck to comprise a permanent external configuration relative to the body, and providing the neck cross-sectional dimension to be substantially parallel with, centered relative to, and less than, the body cross-sectional dimension.

Other examples and embodiments are further disclosed herein. Such examples and embodiments may be found in the figures, in the claims, and/or in the description of the present application.

Referring now to the figures, FIG. 1 is a block diagram of an audio receiving system 100 for an MP3 player 108, according to an embodiment of the present invention. It should be understood that system 100 is merely exemplary and that the present invention may be employed in many different system and circuits not specifically depicted herein.

As an example, as shown in FIG. 1, system 100 can include: a stereo receiving system 101, an audio interface 102, an external audio input interface 104, an automatic gain control switch 150, a power switch 133, an external sync connector 106 and conductors 157, 169, 194, 197, and 198. In the illustrate embodiment, system 100 is at least partially enclosed in a housing 103. Interface 102 is configured to be plugged into and electrically coupled to the MP3 player 108. Interface 102 can transfer communication, power and audio signals between system 101 and MP3 player 108, as described below. It will be understood that MP3 player 108 is not, or need not be, a component of system 100, but is merely shown to facilitate understanding of system 100 and the way in which it may function.

In one embodiment, system 101 includes: microphones 110 and 112, a digital audio processor 120, a stereo/mono switch 152, differential output drivers 144 and 146, a digital processor 142, an external audio source detection circuit 140, a user notification mechanism 148 and conductors 143, 149, 184, 185, 186, 187, 188, 189, 190, 191, 192, 193, and 195. Conductors 143, 149, 157, 169, 184, 185, 186, 187, 188, 189, 190, 191, 192, 193, 194, 195, 197, and 198 can be wires, conductive material deposited on a semiconductor device, or any other type of material that can be used to electrically couple two electrical components. "Conductor" and "conductors" as they are used herein, can refer to a single conductor or two or more conductors, depending on the number of conductors used to electrically couple two electronic elements.

In one embodiment, system 101 receiving sounds and converts the sounds into audio signals, which are processed by processor 120 before being transmitted by interface 102 to MP3 player 108. In one embodiment, the system 101 transmits stereo audio signals to the MP3 player 108, which stores the sounds in one of the aforementioned file formats. For example, the MP3 player can save the audio signals as uncompressed WAV files. In one embodiment, the audio signals, for example, can be saved at high or low quality. The high quality audio signal can be a 16-bit stereo, 44.1 KHz (kilohertz) signal, with a bit rate of 1211 kb/sec (kilobytes per second), while the low quality audio signal can be a 16-bit monaural, 22.05 KHz signal, with a bit rate of 352 kb/sec, as an example. In another embodiment, the user can set the quality of the recording to other values.

The stereo audio signals can be received by microphones 110 and 112. A microphone is an acoustic to electric transducer that converts sounds into electrical signals, i.e., audio signals. The construction of various types of microphones are well-known in the art and will not be depicted herein.

In some embodiments, microphones 110 and 112 are omni-directional microphones. Omi-directional microphones are non-directional microphones having sound responses substantially spherical in three dimensions. Omni-directional microphones can be less sensitive than other types of microphones to low-frequency sounds from sources in close proximity and, thus, can be preferable for use with some MP3 players with hard-disk storage systems. In many situations, the spinning of the hard disk can create a considerable amount of low-frequency noise, which can ruin the quality of the audio recording when using microphones highly sensitive to low-frequency sounds.

In another embodiment, microphones 110 and 112 are uni-directional microphones. Uni-directional microphones differ from omni-directional microphones in that they are more sensitive to sounds from a single direction. Usually, uni-directional microphones are preferable to omni-directional for stereo recording because of their better overall performance. However, uni-direction microphones are sensitive to low-frequency noise from sources in close proximity and thus in some situations should not be used with MP3 players with hard-disk storage systems. In various embodiments, uni-direction microphones can be used with MP3 players, which use Random Access Memory (RAM) and other types of static media to store audio files.

FIG. 2 is a diagram illustrating the relative placement of the microphones 110 and 112 in one embodiment of the audio receiving system 100. In this embodiment, the microphones 110 and 112 are secured internally to housing 103 with a central axis 215 of microphone 110 placed at an angle 211 with respect to a central axis 216 of microphone 112. As an example, axis 215 can be placed substantially parallel to axis 216, i.e., angle 211 is approximately 180 degrees. A 180-degree angle is preferable in some embodiments when using omni-directional microphones because the 180-degree angle provides the highest quality of stereo sound recording for this type of microphone.

In another embodiment, axis 215 can be placed substantially orthogonal to axis 216, i.e., angle 211 is approximately 90 degrees. A 90-degree angle is preferable in some embodiments when using uni-directional microphones because a stereo effect in the audio signal can be achieved simply through the intensity differences between the sound entering each of the microphones 110 and 112.

In the same or a different embodiment, microphones 110 and 112 are placed close together but not abutting. For example, microphones can be placed 10 mm apart. In another embodiment, a portion of microphone 110 is secured inside of housing 103 on the right side and a proportion of microphone 112 is secured inside of housing 103 on the left side.

In the embodiment shown, each microphone 110 and 112 outputs a single audio signal and are electrically coupled by conductors 185 and 186 to a digital audio processor, respectively. In one example, microphone 112 outputs an audio signal for a right channel and microphone 110 outputs an audio signal for a left channel.

Processor 120 includes an amplifier to regulate the gain of the audio signals from microphones 110 and 112. In one embodiment, processor 120 can be a standalone integrated circuit (IC). For example, processor 120 can be a Philips UDA1341TS. In other embodiments, processor 120 can be analog or discrete circuitry.

As shown in FIG. 1, processor 120 can include: pregain control mechanisms 121 and 122, switching switches 125 and 126, and automatic gain control mechanisms 123 and 124 It should be understood that processor 120 is merely exemplary and that the present invention may be employed in many different combination of mechanisms, switches, and circuits not specifically depicted herein.

The inputs of mechanisms 121 and 122 are electrically coupled by conductors 185 and 186 to the output of microphones 112 and 110, respectively. The outputs of the mechanisms 121 and 122 are electrically coupled by conductors 187 and 188 to the inputs of switches 125 and 126, respectively. The output of switch 125 is electrically coupled by conductors 189 and 190 to the input of mechanism 123 and driver 146, respectively. The output of switch 126 is electrically coupled by conductors 191 and 192 to the input of mechanism 124 and switch 152. The outputs of mechanisms 123 and 124 are electrically coupled to conductors 190 and 192 at nodes 153 and 155, respectively. In one embodiment, system 101 allows the user to enable or disable the automatic gain control through switches 125 and 126. In other embodiments, automatic gain control is always enabled or disabled.

Mechanisms 121 and 122 include amplifiers for amplifying a low level, possibly high impedance, audio signal from microphones 112 and 110 to line level. For example, mechanisms 121 and 122 can raise the signal to −10 dbV (decibel volts) or +4 dBu (decibel volts unloaded). In the same or different embodiments, equalization and tone control can also be applied to the audio signals by mechanisms 121 and 122.

When the automatic gain control is enabled, mechanisms 121 and 122 can apply a moderate amount of gain. When the automatic gain control is disabled, mechanisms 121 and 122 can apply a gain suitable for recording louder sounds and environments. As an example, the gains applied by mechanisms 121 and 122 can be slightly less than one. That is, the gains applied by mechanisms 121 and 122 can be set at a constant level that is appropriate for most voice recordings. In another embodiment, there is some pre-amplification when automatic gain control is off, and the user is using the built-in microphones. In the embodiment, the gain is no longer slightly less than one in this case.

Mechanisms 123 and 124, in the illustrate embodiment, include amplifiers for providing automatic gain control to the audio signals from mechanisms 122 and 121, respectively. When enabled, mechanisms 123 and 124 can be used to automatically control the volume of the audio signal from the microphones 110 and 112. Specifically, mechanisms 123 and 124 can ensure that output audio signals from processor 120 are maintained at constant levels in the face of widely varying input audio signal levels. Typically, mechanisms 123 and 124 are used to maintain a constant audio signal strength by adjusting the gain dynamically to the best level possible to avoid clipping of the audio signals for louder signals.

In one embodiment, switch 125 can toggle the output of mechanism 121 between mechanism 123 and driver 146 based on an automatic gain on/off signal from processor 142. Based on the same signal from processor 142, switch 126 can toggle the output of mechanism 122 between mechanism 124 and switch 152. When automatic gain is enabled (i.e., mechanisms 123 and 124 are on), the output of switches 125 and 126 can be coupled to the input of mechanisms 123 and 124, respectively. When automatic gain is disabled, the output of switches 125 and 126 can be coupled to driver 146 and switch 152, respectively. The construction of switches 125 and 126 is well-known in the art and will not be depicted herein.

Processor 142 provides the automatic gain on/off signal to processor 120 through conductor 193, based on a signal from switch 150 in one embodiment. Switch 150 allows the user of system 100 to select whether the automatic gain control mechanisms 123 and 124 are enabled or disabled. As an example, switch 150 can be a physical switch, which is operated manually by the user and is electrically coupled to processor 142 by conductor 194. In another example, switch 150 is a portion of processor 142. In this embodiment, a user turns on or off mechanisms 123 and 124 through a menu on a screen 109 on the MP3 player 108. The selection by the user on the MP3 player 108 is transmitted to the processor 142 using a method described below. In one embodiment, switches 125, 126, and 150 along with processor 142 form a gain disabler mechanism 154. In other embodiments, processor 142 and/or switches 125 and 126 can form the gain disabler mechanism 154.

In one embodiment, the output of switch 126 and the output of mechanism 124 can be electronically coupled by conductor 192 to switch 152. The output of switch 152 can be electrically coupled to differential output driver 144 by conductor 195; switch 152 also can be electrically coupled to conductor 190 at node 151. Switch 152 is used to toggle the recording mode between stereo and mono. As an example, the user can choose the recording mode in a menu on the screen 109 of the MP3 player 108. When the user chooses the recording mode, the MP3 player 108 communicates the selection to processor 142. Processor 142 sends an electrical signal to switch 152 indicating the recording mode. In a non-illustrated embodiment, a physical switch is coupled to the housing 103 and electrically coupled to switch 152 through processor 142 to allow the user to select manually the recording mode. The construction of switch 152 is well-known in the art and will not be depicted herein.

When the user selects to record in stereo, the audio signal from switch 152 can be electrically coupled to driver 144 through conductor 195. When the user selects to record in mono, the audio signal from switch 152 can be combined with the audio signal from mechanism 123 or switch 125 at node 151.

In one embodiment, drivers 144 and 146 convert the audio signals from processor 120 from signals in reference to the ground of system 101 to signals in reference to the ground of MP3 player 108. In another embodiment, drivers 144 and 146 convert the audio signals from processor 120 into differential audio signals. Drivers 144 can be used in an embodiment of system 101 where the MP3 player 108 uses differential signaling. In differential signaling systems, instead of reading single signals, the receiving device uses the difference between the two signals.

In a different embodiment, MP3 player 108 uses conventional single-ended signaling and the reference ground is not relevant, and thus drivers 144 and 146 are not necessary. In this embodiment, the outputs of processor 120 are electrically coupled directly to interface 102.

Power to system 100 can be toggled by the user using switch 133 in some embodiments. Switch 133 can be coupled to processor 142 by conductor 143. In other embodiments, the user can power up or power down system 100 through a menu on the screen 109.

System 100 can also includes interface 104 for receiving audio signals from an external audio source. The external audio signals can be either stereo or mono. As an example, the interface can be a 3.5 mm TRS connector. Interface 104 can contains two channels 171 and 172 electrically coupled to conductors 192 and 191, respectively. Conductor 191 electrically couples channel 172 to mechanism 121 and conductor 192 electrically couples channel 171 to mechanism 122. At node 159, channel 172 is electrically coupled to circuit 140. Circuit 140 can detect whether an external source is coupled to interface 104. Detection using circuit 140 is done using a transistor circuit that relies on the jack-normaling properties of the interface 104, as well as the internal resistance of the microphones 110 and 112. Circuit 140 informs processor 142 whether or not something is plugged into the interface 104. However, in one embodiment, the actual switching between the microphone input and the signal from a source connected to interface 104 is accomplished through the jack-normaling property of interface 104. If nothing is plugged into the interface 104, interface's 104 output will be the signals from microphones 110 and 112.

In one embodiment, processor 142 is electrically coupled to circuit 140 by conductor 184. Circuit 140 sends an electronic signal to processor 142 on conductor 184 when an external device is electrically coupled to interface 104. Upon receiving a signal from circuit 140 indicating the presence of an external device, processor 142 sends a signal on conductor 193 to processor 120 to possibly modify the amplification applied to the incoming audio signals. Additionally, microphones 110 and 112 can be turned off when an external device is present by processor 142.

Processor 120 treats the audio signal from the external device similar to signals from microphones 110 and 112 when mechanisms 123 and 124 are enabled. When mechanisms 123 and 124 are disabled, mechanisms 121 and 122 can slightly attenuate the input signal for line-level inputs. In one embodiment, processor 120 can send a signal to processor 142 on conductor 193 when the audio signals from the external device are being clipped by mechanisms 123 or 124.

System 101 also includes a mechanism 148 to communicate the status of system 100 to the user. In one embodiment, mechanism 148 is electrically coupled to processor 142 by conductor 149. As an example, mechanism 148 can be a light source. In one embodiment, mechanism 148 can include a LED (light emitting diode). In one example of a lighting scheme, the LED is turned off by processor 142 when MP3 player 108 is not recording and blinks twice quickly when the MP3 player 108 asks the processor to begin receiving audio signals. Additionally, the LED blinks twice upon attaching system 100 to MP3 player 108, and also blinks twice when the user presses a button on the left side of the MP3 player 108. The button on MP3 player 108 allows the user to instruct the MP3 Player 108 to go to its recording interface. Furthermore, the LED is lit when the MP3 player 108 is recording and blinks quickly when processor 120 is clipping the audio signals from the external device. In other embodiments, different lighting schemes can be used to notify the user of the status of system 101.

As another example, mechanism 148 can be a display screen secured to the housing 103 and electrically coupled to processor 142. On this display screen, the user can monitor the functioning of system 100. In a further example, mechanism 148 can be a speaker to create a variety of sounds to alert the user to the status of system 101.

Processor 142 controls the operation of system 101. All communications from interface 102 to system 101 are sent to processor 142 from interface 102 over conductor 169. Conductor 169 can include one or more individual conductors. In one embodiment, processor 142 is a microcontroller. For example, processor 142 can be an eight bit microcontroller sold under the trademark PSOC by Cypress of San Jose, Calif., or an eight bit microcontroller sold under the trade name C8051F331 or C8051F333 by Silicon Laboratories of Austin, Tex.

In one embodiment, system 101 is controlled by the user through MP3 player 108. As an example, a menu system on screen 109 of MP3 player 108 can be used by the user to begin recording, delete previous recordings, stop recording, enable or disable the automatic gain control, select the recording mode, set recording quality, etc. The instructions from MP3 player 108 are passed through interface 102 to processor 142. Processor 142 then implements the instructions from the user.

Figure 3:
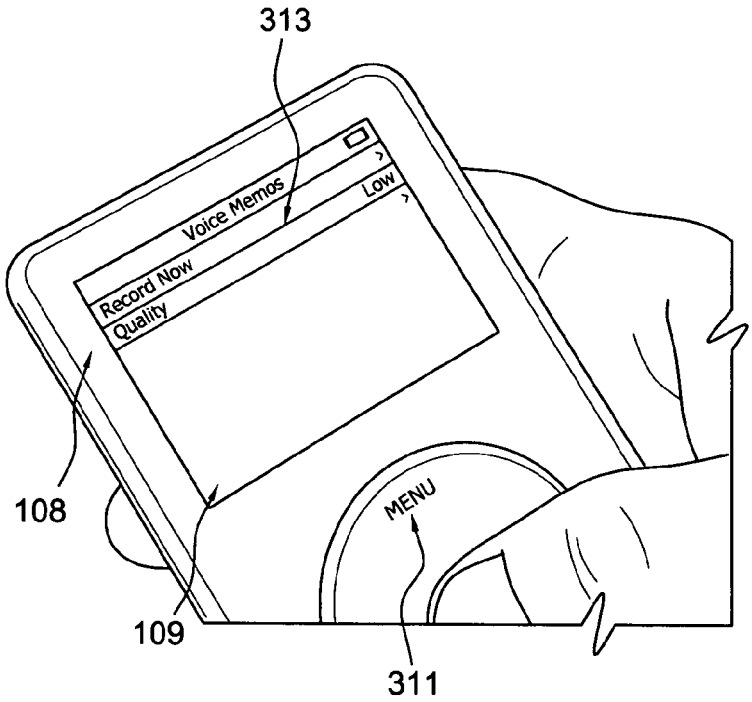
FIG. 3 illustrates a first menu on a screen of the MP3 player for use with the audio receiving system of FIG. 1 according to an embodiment of the invention.
Figure 4:
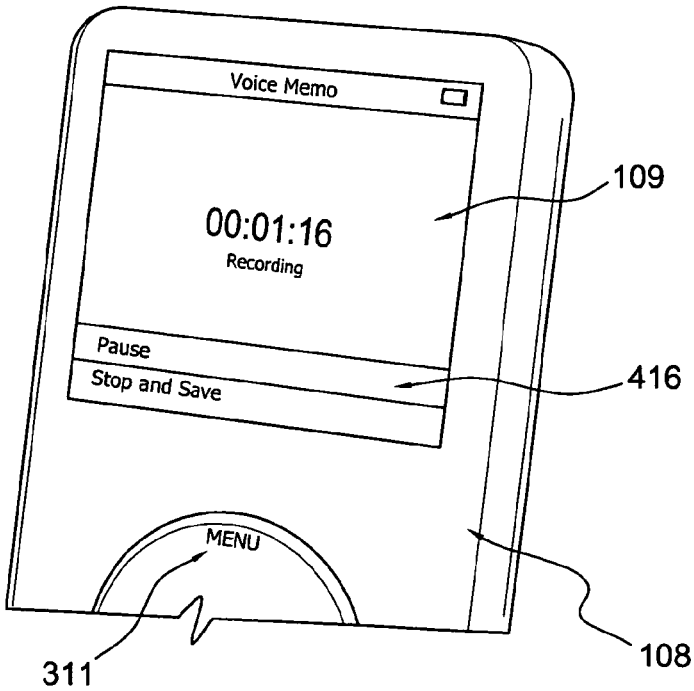
FIG. 4 illustrates a second menu on a screen of the MP3 player for use with the audio receiving system of FIG. 1 according to an embodiment of the invention.

As an example, FIG. 3 illustrates an example of a menu on a screen 109 of an MP3 player 108 for use with an embodiment of system 100, and FIG. 4 shows another example of a menu on screen 109 of an MP3 player 108 for use with an embodiment of system 100.

In FIG. 3, menu 313 on screen 109 allows a user to begin recording audio signals or change the quality of the audio file to be recorded. If the user highlights "Record Now" on menu 313 by using a flywheel 311 and clicks a button on the flywheel 311, MP3 player 108 can send a signal to processor 142 instructing system 100 to begin receiving audio signals. If the user highlight and clicks on "Quality," the user can change the quality of the audio recording.

In one embodiment, after the system has begun recording, MP3 player 108 displays menu 416 on screen 109, as shown in FIG. 4. Menu 416 displays the recording time and give the user the option to "Pause" and "Stop and Save" the recording process. If the user highlights either of these options using flywheel 311 and clicks a button on the flywheel 311 to select the option, a signal is sent from the MP3 player 108 to the processor 142 instructing system 100 to stop recording. If the user had selected "Pause," another menu is displayed to the user to allow the restart or stop the recording process. If the user selected "Stop and Save," the recording process is stopped and the audio recording is saved in the memory of MP3 player 108. In another embodiment, another menu is displayed to allow the user to decide whether to save the recording, discard or playback the recording.

In another embodiment, the user can control one or more of the functions listed above through controls located on the housing 103 and electrically coupled to the processor 142.

Communications between system 101 and MP3 player 108 are performed through interface 102. In one embodiment, interface 102 includes a connector 163. The type of connector 163 depends on the type of connector 196 of interface 145. For example, interface 102 can include a thirty-pin male serial connector configured to be plugged into and electrically coupled to an Apple iPod. In another example, the MP3 player 108 has a female USB connector for coupling with external devices. Then, connector 163 would be a male USB connector.

Figures 5, 6:
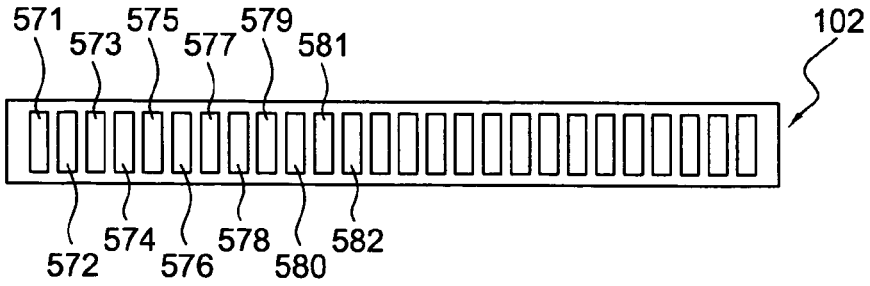
FIG. 5 is a top view of the audio interface of the audio receiving system of FIG. 1 according to an embodiment of the invention.
FIG. 6 illustrates a pin layout diagram for the audio interface of the audio receiving system of FIG. 1 according to an embodiment of the invention.

FIG. 5 illustrates a top view of interface 102 according to an embodiment of the present invention, and FIG. 6 illustrates a pinout diagram for interface 102 according to an embodiment of the present invention. It should be understood that pin layer and diagram of FIGS. 5 and 6, respectively, are merely exemplary and that the present invention may be employed in many different layouts and designs not specifically depicted herein.

In the example of FIGS. 5 and 6, pins 572 and 573 are electrically coupled to conductors 197 and 198, respectively. Pins 572 and 573 relay the output audio signals of system 101 to MP3 player 108. In another embodiments, pin 574 is also a audio output pin. Control signals between the MP3 player 108 and processor 142 are sent through pins 576 and 577. Pins 576 and 578 are electrically coupled to processor 142 through conductor 169. As an example, pin 576 can be a sending line (T×D) for system 100, and pin 577 can be a receiving line (R×D) for system 100. In one embodiment, the interface 145 and interface 102 include a universal asynchronous receiver-transmitter (UART) controller to facilitate communications over the serial pins 572, 573, 576, and 577. Additionally, the protocols used by the MP3 player 108 and processor 142 for communication are well-known in the art and will not be depicted herein. Additionally, system 100 can also include separate hand shaking circuitry, if required by MP3 player 108.

As shown in FIG. 6, the power to operate system 100 is provided through pin 578. As an example, system 100 can operate on 3.3 V (volt) power. Pins 571, 574, and 575 are grounds.

In one embodiment, pins 579, 580, 581, and 582 are electrically coupled to the external sync connector 106 through conductor 157, as shown in FIG. 1. Connector 106 can be electrically coupled to an external device to allow the MP3 player 108 to be synced with the external device and to allow data to be uploaded to the MP3 player 108 from the external device. For example, connector 106 can be a USB connector, which can be coupled to a computer through a USB cable. In this example, pins 580 and 581 are USB data pins and pins 579 and 582 are power pins.

Figure 8:
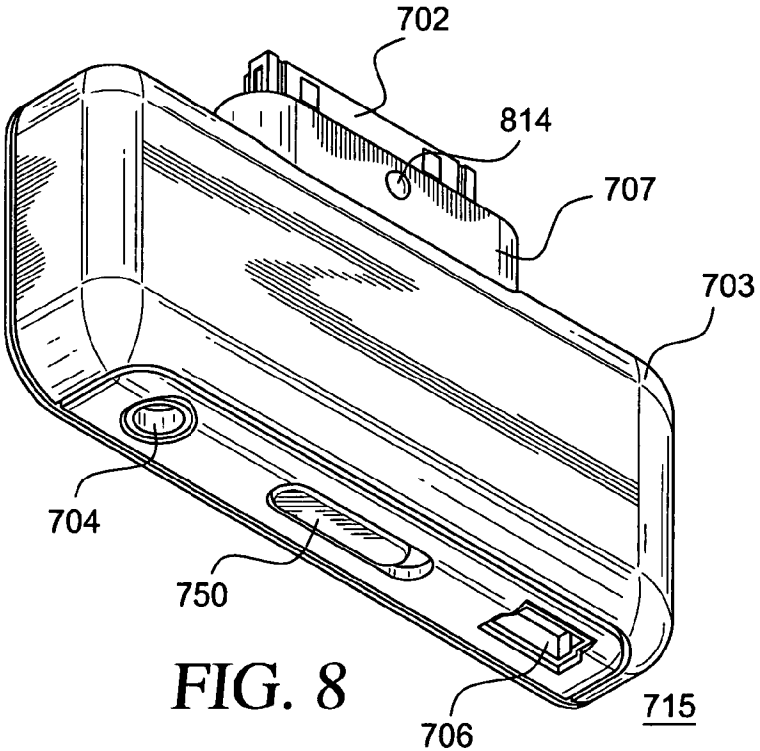
FIG. 8 is a back, left, bottom isometric view of the electrical accessory of FIG. 7 according to an embodiment of the invention.
Figure 7:
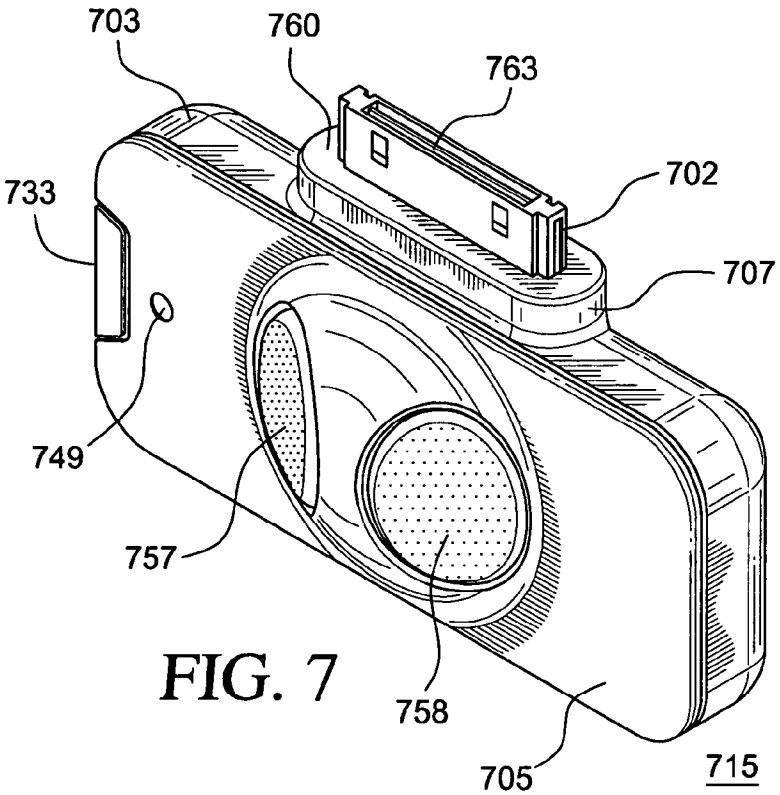
FIG. 7 is a front, right, top isometric view of an electrical accessory according to an embodiment of the invention.

As mentioned above, system 101 can be secured to and located internally to housing 103. An electrical accessory 715 having a housing 703 similar to housing 103 will now be described. FIG. 7 is a front, right, top isometric view of electrical accessory 715, and FIG. 8 is a back, left, bottom isometric view of accessory 715. It should be understood that electrical accessory 715 is merely exemplary and that the present invention may be employed in many different systems and circuits not specifically depicted herein.

As an example, accessory 715 can include housing 703, electrical component 701 (not shown), an electrical interface 702, and electrical conductors 790 (not shown). Housing 703 can be hollow and component 701 can be located at least partially within housing 703. "Component 701" as it is used herein, can refer to a single electrical component or to two or more electrical components.

In one embodiment, housing 703 can include a body 705 with a neck 707. Neck 707 can be partially enclosed interface 702 with interface 702 protruding from the top surface of neck 707. In one embodiment, neck 707 is an oval-shaped tube extending outward from the top surface of the body 705. In other embodiments, the neck portion can extend outward from other sides of the body 705 and have different shapes. For example, the neck 707 can be a cubic and extend outward from a surface of body 705.

In one example, body 705 is a rectangular box with smooth rounded corners with multiple control and user notification mechanisms protruding from the sides. In same or different embodiment, the width and length of the box is approximately the width and length of device 708.

As shown in FIG. 7, neck 707 can have one or more cross-sectional dimensions that are substantially smaller than the corresponding cross-sectional dimensions of body 705. That is, the length and width of neck 707 are less than the length and width of body 705, respectively, with the length of the neck being substantially less. Furthermore, the length and width of neck 707 are greater than the length and width of interface 702, respectively.

In one embodiment, component 701 can include system 101, interface 102, interface 104, switch 150, switch 133, and connector 106; i.e., component 701 can be similar to system 100 and housing 703 can be similar to housing 103. In this embodiment, switch 150 and interfaces 104 and 106 are located on the bottom of body 705. Mechanism 148 is visible through an opening 749 on the front surface of body 705. Switch 133 is located on the left front corner of body 705. In another embodiment, the entire system 101 can be located internal to housing 703 and system 100 is controlled through menus on electronic device 708.

In other embodiments, other electrical components 701 can be enclosed in housing 703. For example, an FM (frequency modulation) transmitter for an MP3 player can be enclosed in another embodiment of housing 703. In general, any electrical accessory capable of being electrically coupled to an MP3 player or other electrical device through an interface 702 can be enclosed in housing 703.

Component 701 is configured to be electrically coupled to electronic device 708 through electrical interface 702. Two or more electrical conductors 790 electrically couple the electrical component 701 to the electrical interface 702. For example, electrical conductors 790 can be similar to conductors 169, 197 and/or 198.

Electronic device 708 can be an MP3 player, similar to MP3 player 108, or any other electrical device with an electrical interface 745. It will be understood that device 708 is not, or need not be, a component of accessory 715, but is merely shown to facilitate understanding of housing 703 and the way in which it may function.

In one embodiment, interfaces 702 and 745 include connectors 763 and 796, respectively. The connectors 763 and 796 are a matching pair of connectors. For example, interface 702 can be similar to interface 102, connector 763 can be similar to connector 163, and interface 745 is similar to interface 145. In one example, connector 763 can be a 30-pin serial male connector and connector 796 can be a 30-pin serial female connector. In other examples, interfaces 702 and 745 can include matching male and female parallel port firewall or USB connectors.

Housing 703 is preferably made of a material that is tough, hard, and rigid, has good chemical resistance and dimensional stability, exhibits good creep resistance, is relatively strong, and inexpensive. Accordingly, housing 703 can be constructed of acrylonitrile butadiene styrene (ABS), polycarbonate, polypropylene, polyethylene, or a similar material, all of which, to varying degrees, exhibit the stated properties. In one embodiment, housing 703 is made using an injection molding process. Injection molding processes for creating plastic housings are well-known in the art and will not be depicted herein. In another embodiment, portions 757 and 758 on the front face of housing 703 can be made from a different material. For example, portions 757 and 758 can be made from a metal.

Figure 9:
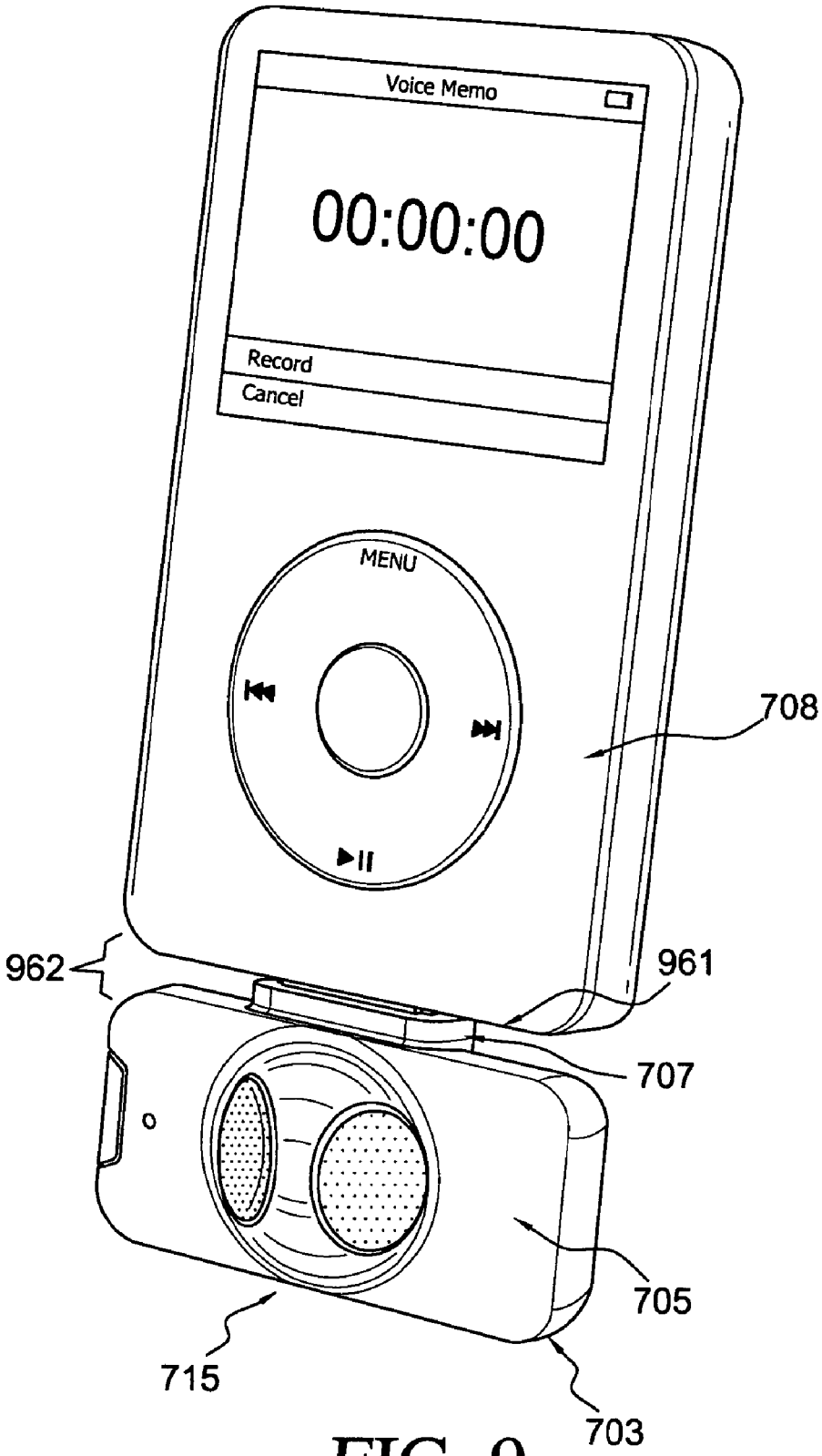
FIG. 9 illustrates a front, right, top isometric view of the electrical accessory of FIG. 7, according to an embodiment of the invention, coupled to an electronic device.

FIG. 9 illustrates a front, right, top isometric view of housing 703 coupled to device 708. When interface 702 is plugged into interface 745, the top surface 760 (FIG. 7) of neck 707 is in contact with the bottom surface 961 of device 708, as shown in FIG. 9. That is, surface 760 is flush with surface 961. A gap 962 exists between device 708 and body 705. The length of the gap 962 is approximately equal to the height of neck 707.

Figure 10:
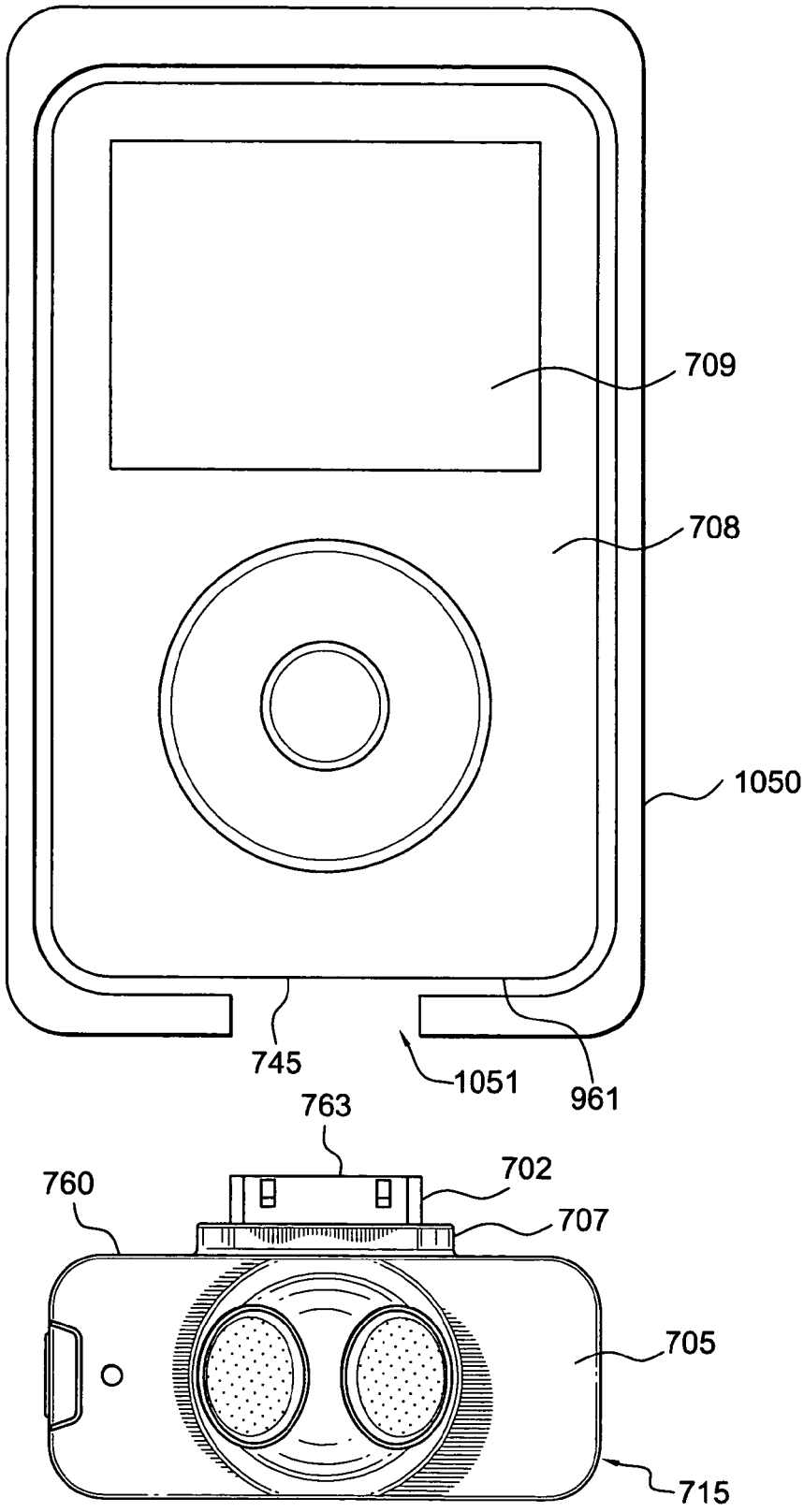
FIG. 10 illustrates a front view of an electronic device in a protective case enclosing to the electrical accessory of FIG. 7 according to an embodiment of the invention.

FIG. 10 illustrates a front view of device 708 in a protective case 1050 and accessory 715 according to an embodiment of the invention. Case 1050 surrounds and protects device 708 from scratches and dents. When device 708 is enclosed in case 1050, an opening 1051 in case 1050 is located below interface 745. Opening 1051 allows external electrical accessories to be plugged into and electrically coupled to device 708 through interface 745. The length of opening 1051 is usually larger then the length of 745. In some cases, the length of opening 1051 is only slightly less than the length of surface 961. Traditionally, when external devices are plugged into device 708, case 1050 does not allow the external accessory to sit flush with bottom of the device 708 and thus the electrical coupling between device 708 and the external electrical accessory is of poor quality.

However, when interface 702 is plugged into interface 745, neck 707 slides into opening 1051 and a good electrical coupling can be achieved between interfaces 745 and 702. Surface 760 of body 705 is in contact with surface 961 of device 708 and gap 962 (FIG. 9) is filled by case 950. Thus, accessory 715 allows a good electrical coupling between interfaces 745 and 702, even when the device 708 is enclosed in case 1050.

In one embodiment, the width and length of the neck 707 is the width and length of the connector 763 plus a minimum wall thickness necessary to guarantee stability. In the same or different embodiments, the dimensions of neck 707 can be related to the dimensions of case 1050. For example, the height of neck 707 can be greater than the thickness of most protective cases, or the thickness of protective cases made by one specific manufacturer. In one embodiment, the length and width of neck 707 can be set to be smaller than the width and length of the opening 1051 in most protective cases or one specific brand of protective case. Setting the dimensions of neck 707 in relation to the dimensions of the protective cases ensures a good coupling can be achieved between component 701 and 708 when most brands of protective cases are used.

Figure 11:
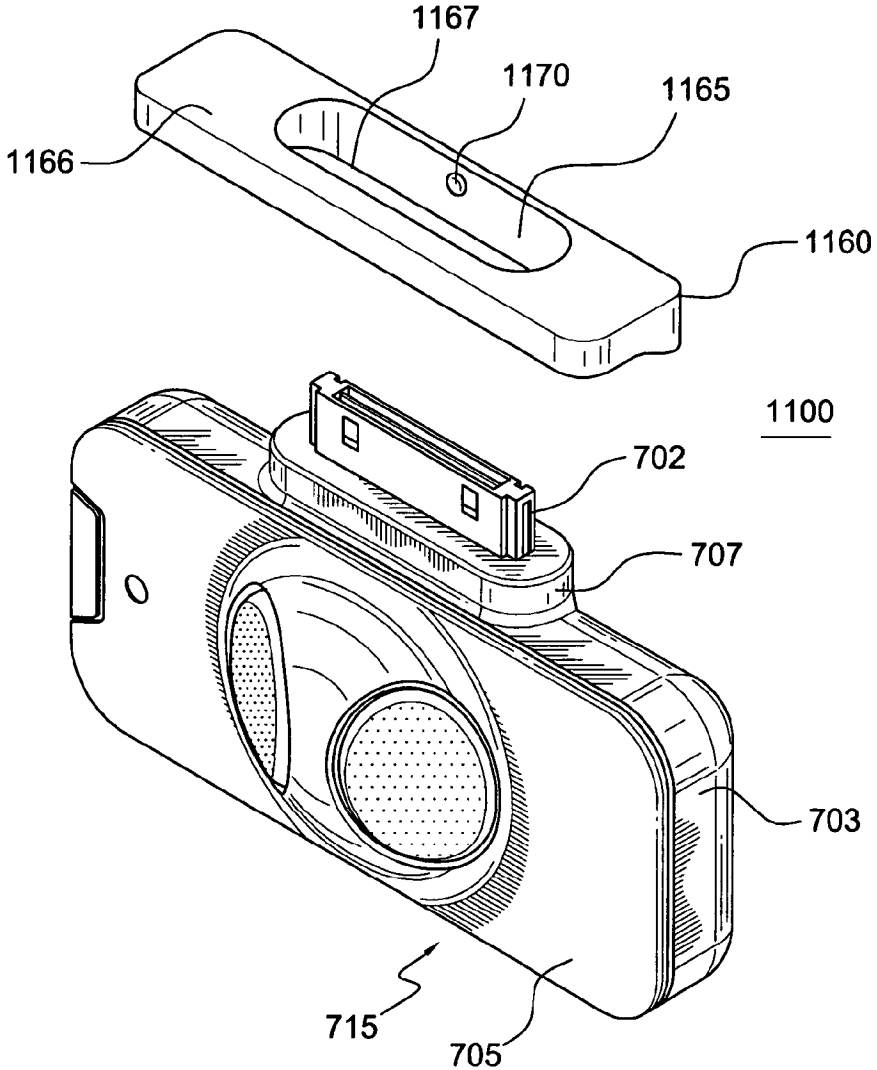
FIG. 11 is a front, right, top isometric view of electrical accessory according to another embodiment of the present invention.
Figure 12:
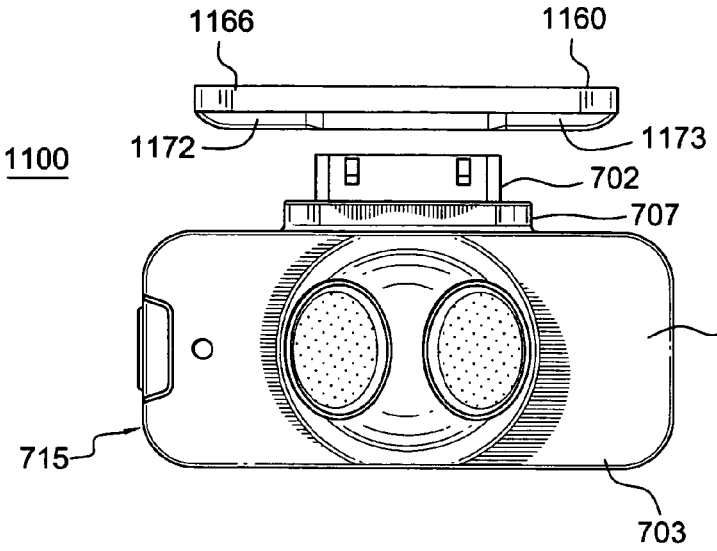
FIG. 12 is front view of the electrical accessory of FIG. 11 according to an embodiment of the invention.
Figure 13:
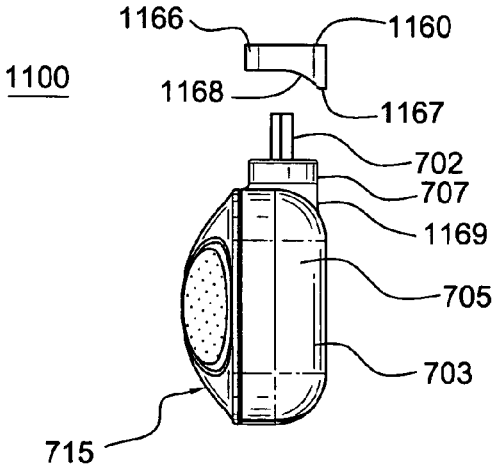
FIG. 13 is a side view of the electrical accessory of FIG. 11 according to an embodiment of the invention.
Figure 14:
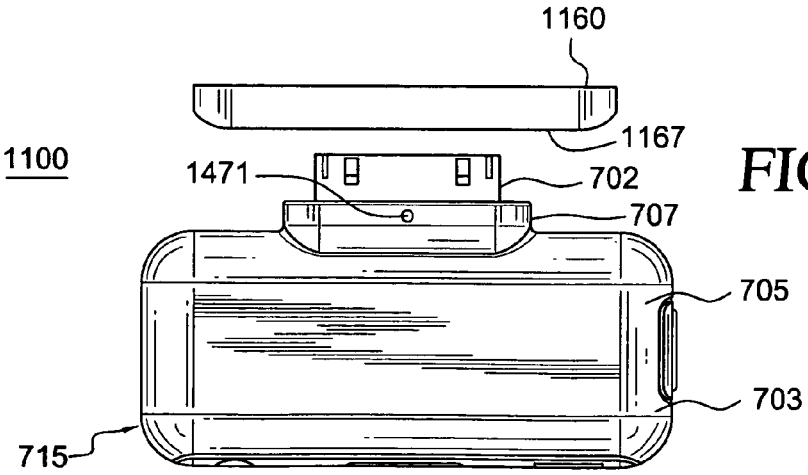
FIG. 14 is a back view of the electrical accessory of FIG. 11 according to an embodiment of the invention.

FIGS. 11, 12, 13, and 14 illustrate a further embodiment of an accessory 1100 capable of coupling to device 708. FIG. 11 is a front, right, top isometric view of accessory 1100 according to an embodiment of the invention. FIG. 12 is front view of accessory 1100 according to an embodiment of the invention. FIG. 13 is a side view of accessory 1100 according to an embodiment of the invention. FIG. 14 is a back view of accessory 1100 according to an embodiment of the invention.

In this embodiment, accessory 1100 includes accessory 715 and a spacer 1160. Spacer 1160 is sized and shaped to removably fit around the neck 707. An opening 1165 is located approximately in the center of spacer 1160. Spacer 1160 is used to fill the gap 962 (FIG. 9) when device 708 is not enclosed in a case.

In one example, spacer 1160 includes a disk portion 1166 and a lip portion 1167. Portion 1166 can be a rectangular disk with opening 1165 located approximately in the center. As an example, the length and width of spacer 1160 can be approximately equal to the length and width of device 708 or accessory 715. In other embodiments, the rectangular portion can have different shapes. In the same or different embodiment, portion 1166 can be partially hollowed out to decrease the amount of material need to form spacer 1160. For example, spacer can have two hollowed out portions 1172 and 1173.

Portion 1167 can extend outward substantially perpendicular to the width and the height of portion 1167. In one embodiment, portion 1167 decreases in thickness toward an edge 1774. The inside face 1168 of portion 1167 can have a radius of curvature approximately equal to the radius of curvature of a portion of surface 1169 of the body 705. When spacer 1160 is coupled to accessory 715, portion 1167 increases the amount of surface area on housing 703 and spacer 1150 in contact. Having increased surface contact allows for a more stable and secure coupling of housing 703 and spacer 1160. In other embodiments, spacer 1160 does not include portion 1167 or portion 1167 has a different shape or size.

In the same or different embodiment, housing 703 and spacer 1160 can include a locking mechanism. For example, spacer 1160 can include a dimple 1170 and housing 703 can include a protrusion 1471, as shown in FIGS. 11 and 14. Protrusion 1471 can be configured to be coupled to the dimple 1170. That is, protrusion 1471 and dimple 1170 can be positioned such that when device 708 and spacer 1160 are coupled, protrusion 1471 can be snapped into and locked within dimple 1170 to help hold neck 1170 and housing 703 together. In other embodiments, spacer 1160 can include a protrusion and housing 703 can include a dimple. In further embodiments, other locking mechanism can be employed.

Figure 15:
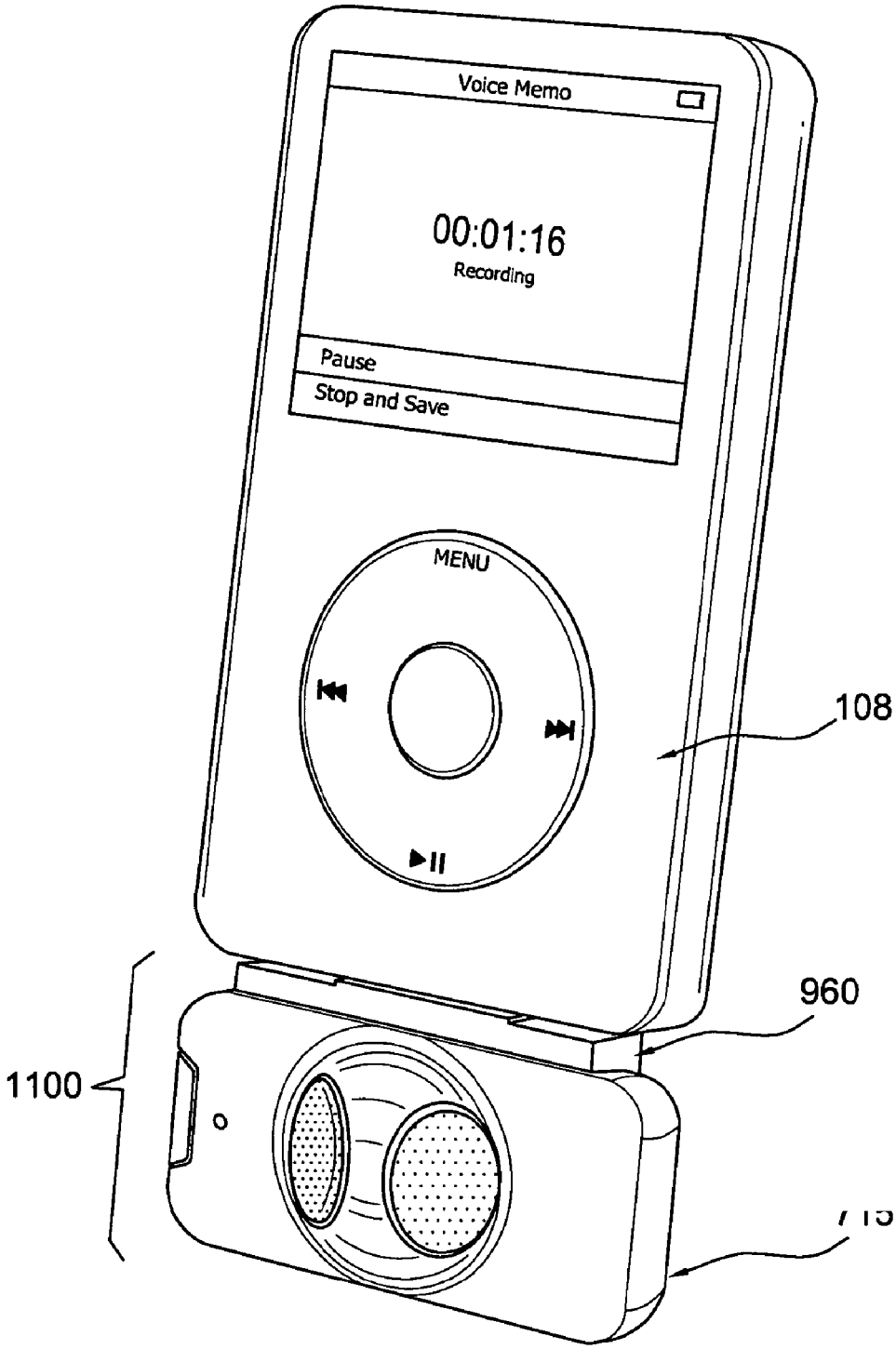
FIG. 15 illustrates a front, right, top isometric view of an electronic device coupled to the electrical accessory of FIG. 11 according to an embodiment of the invention.

FIG. 15 illustrates a front, right, top isometric view of accessory 1100 coupled to device 708 according to an embodiment of the invention. As shown in FIG. 15, in one example, when accessory 1100 is coupled to device 708, the spacer 1160 surrounds neck 707 and fills gap 962 between body 705 and device 708. The top surface of spacer 1160 is in contact and flush with surface 961 and the bottom surface of the spacer 1160 is in contact and flush with the top of body 705. Placing the spacer 1160 between devices 708 and 701 provides stability when coupling the devices 708 and 701 when device 708 is not enclosed in a case.

Figure 16:
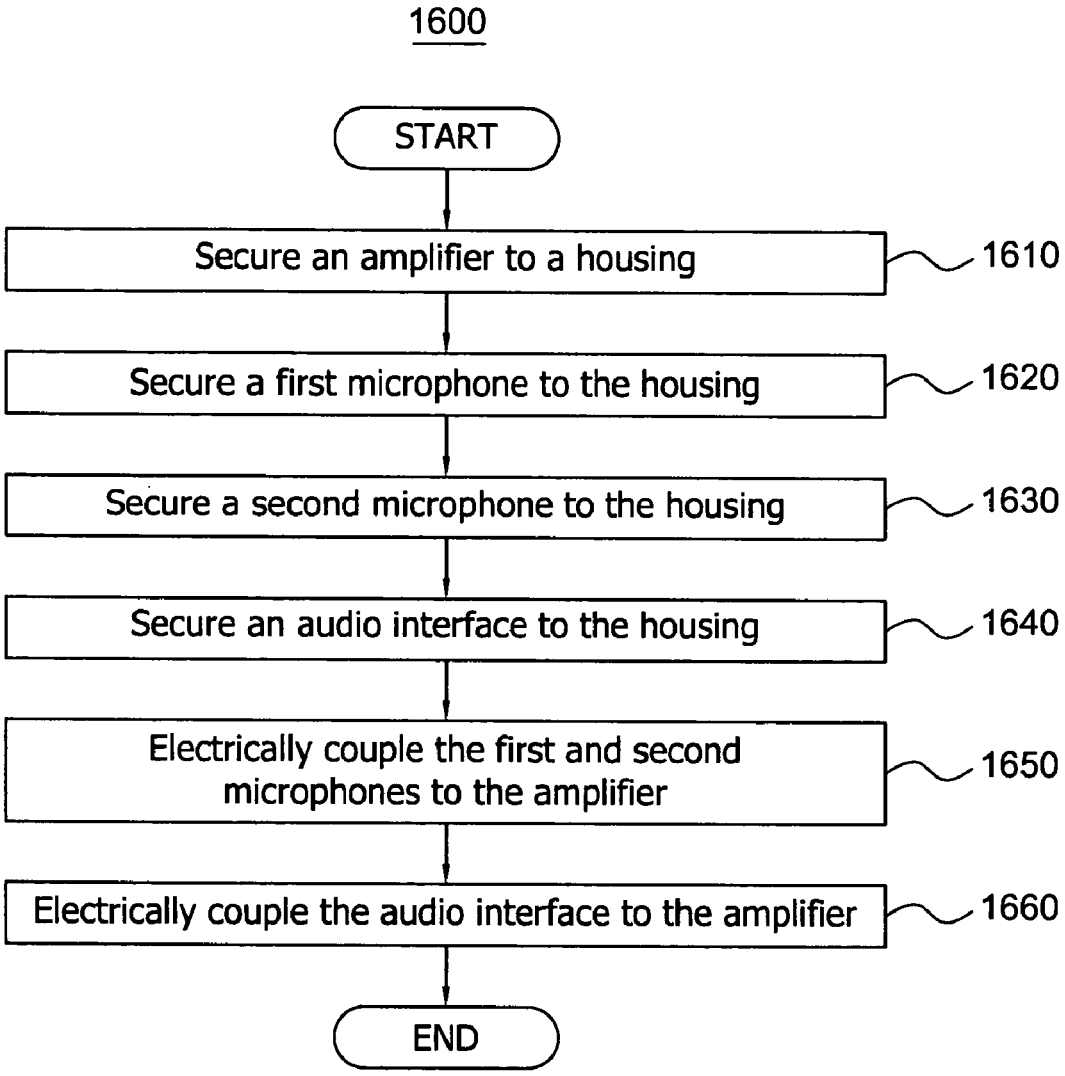
FIG. 16 is a flowchart illustrating a method of forming an audio receiving system for an MP3 player according to an embodiment of the invention.

FIG. 16 illustrates a flow chart 1600 for a method of manufacturing a stereo audio receiving system for an MP3 player according to an embodiment of the present invention. Flow chart 1600 includes a step 1610 of securing a central axis of a first microphone on a housing at an angle in relation to a central axis of a second microphone already secured to the housing. As an example, the first microphone, the second microphone, the housing, and the angle of step 1610 can be similar to microphones 110 and 112, housing 103, and angle 211 of FIGS. 1 and 2, respectively.

Flow chart 1600 in FIG. 16 continues with steps 1620 and 1630 of electrically coupling the first and second microphones to an amplifier respectively. As an example, the amplifier of steps 1620 and 1630 can be similar to digital audio processor 120 of FIG. 1.

Subsequently, flow chart 1600 in FIG. 16 includes a step 1640 of electrically coupling an audio interface to the amplifier, where the audio interface is capable of being electrically coupled to the MP3 player. As an example, the audio interface of step 1640 can be similar to audio interface 102 of FIG. 1.

Figure 17:
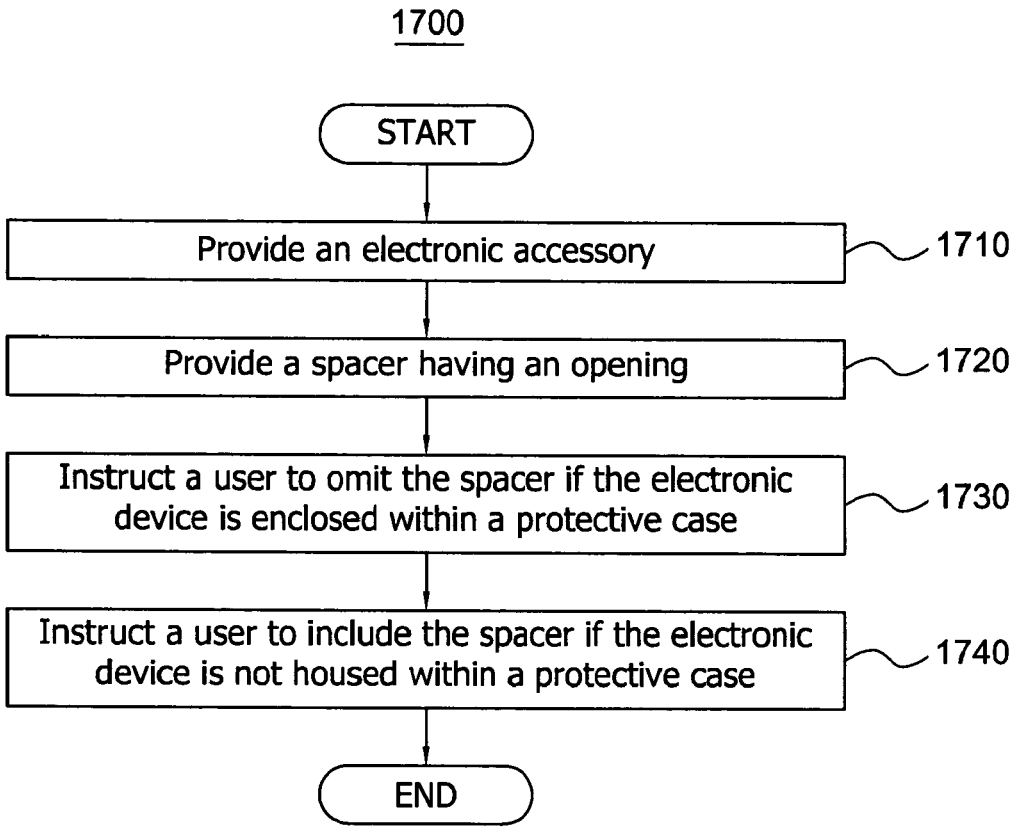
FIG. 17 is a flowchart illustrating a method of providing an electronic accessory capable of providing a stable connection to an electronic device independent of whether the electronic device is housed within a removable protective case according to an embodiment of the present invention.

FIG. 17 is a flowchart illustrating a method of providing an electronic accessory capable of providing a stable connection to an electronic device independent of whether the electronic device is housed within a removable protective case, according to an embodiment of the present invention.

Flow chart 1700 includes a step 1710 of providing an electronic accessory including: (a) a body; (b) a neck extending from the body, the neck having a cross-sectional dimension that is substantially less than a corresponding cross-sectional dimension of the body; (c) an electrical connector located within the neck and configured to electrically connect the accessory to the electronic device; (d) at least one electrical component located at least partially within the body; (e) a plurality of electrical conductors electrically connecting the at least one electrical component to the electrical connector.

As an example, the electronic accessory, the body, the neck, the electrical connector, and the at least one electrical component of step 1710 can be similar to accessory 715, body 705, neck 707, electrical connector 763, and component 701 of FIG. 7. The two or more electrical conductors of step 1710 can be similar to conductors 169, 197, and 198 of FIG. 1.

Flow chart 1700 in FIG. 17 continues with a step 1720 of providing a spacer having an opening wherein the neck can fit at least partially within the opening. As an example, the spacer of step 1720 can be similar to spacer 1160 of FIG. 11.

Subsequently, flow chart 1700 in FIG. 17 includes a step 1730 instructing a user to omit the spacer if the electronic device is enclosed within a protective case. Instructing the user can be accomplished by many different methods. Instruction can be provided in writing or through pictures on the packaging for the electronic accessory and spacer, through inserts in the packaging, through advertising, or on the web. For example, the instructions of step 1630 can be provided by including a drawing similar to either FIG. 9 on the packaging for accessory 715 or accessory 1100.

Next, flow chart 1700 in FIG. 17 includes a step 1740 instructing a user to include the spacer if the electronic device is not housed within a protective case. For example, the instructions of step 1630 can be provided by including a drawing similar to either FIG. 15 on the packaging for accessory 715 or accessory 1100. In one embodiment of the method of flow chart 1700, at least one of steps 1730 or 1740 need to be performed. In another embodiment of the method of flow chart 1700, both steps 1730 and 1740 are required.

Although the invention has been described with reference to specific embodiments, it will be understood by those skilled in the art that various changes may be made without departing from the spirit or scope of the invention. Various examples of such changes have been given in the foregoing description. Accordingly, the disclosure of embodiments of the invention is intended to be illustrative of the scope of the invention and is not intended to be limiting. It is intended that the scope of the invention shall be limited only to the extent required by the appended claims. For example, to one of ordinary skill in the art, it will be readily apparent that the system discussed herein may be implemented in a variety of embodiments, and that the foregoing discussion of certain of these embodiments does not necessarily represent a complete description of all possible embodiments. Rather, the detailed description of the drawings, and the drawings themselves, disclose at least one preferred embodiment of the invention, and may disclose alternative embodiments of the invention.

All elements claimed in any particular claim are essential to the invention claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

The invention claimed is:

1. An electronic accessory for an electronic device, the electronic accessory comprising:

a neck comprising:

a neck surface at an exterior of the electronic accessory;

a neck cross-sectional dimension; and two or more of:

a neck front portion facing a front of the electronic accessory;

a neck rear portion facing a rear of the electronic accessory;

a neck left portion facing a left side of the electronic accessory; or a neck right portion facing a right side of the electronic accessory;

a body coupled to the neck and comprising:

a first body surface at the exterior of the electronic accessory; and a first body cross-sectional dimension greater than and substantially parallel to the neck cross-sectional dimension; and an electrical connector located at least partially within the neck and configured to couple the electronic accessory to the electronic device at a docking end of the electronic device;

wherein:

the neck extends from the body and remains permanently protruded past the first body surface;

when the electrical connector is coupled to the docking end of the electronic device, the first neck surface is closer than the first body surface to the docking end; and at least two of the neck front portion, the neck rear portion, the neck left portion, or the neck right portion are unbounded by the body.

2. The electronic accessory of claim 1, wherein:

the first body surface circumscribes the two or more of the neck front portion, the neck rear portion, the neck left portion, or the neck right portion.

3. The electronic accessory of claim 1, wherein:

each of the neck front portion, the neck rear portion, the neck left portion, and the neck right portion protrudes past the first body surface.

4. The electronic accessory of claim 1, wherein:

the body is configured such that a straight line intersecting two of the neck front portion, the neck rear portion, the neck left portion, or the neck right portion does not intersect the body.

5. The electronic accessory of claim 1, wherein:

the first body surface is non-concave relative to an external portion of the electrical connector.

6. The electronic accessory of claim 1, wherein:

the neck cross-sectional dimension is centered within the first body cross-sectional dimension.

7. The electronic accessory of claim 1, wherein:

the neck surface is substantially parallel to the first body surface and the neck cross-sectional dimension.

8. The electronic accessory of claim 1, wherein:

an end portion of the body, comprising the first body surface, is substantially convex relative to an external portion of the electrical connector.

9. The electronic accessory of claim 1, wherein:

the body further comprises a second body surface coupled to the first body surface; and when the electrical connector is coupled to the docking end of the electronic device:

the second body surface is substantially planar with an electronic display surface of the electronic device.

10. The electronic accessory of claim 1, wherein:

when the electrical connector is coupled to the docking end of the electronic device:

a distance between the docking end of the electronic device and the first body surface is sufficient to accommodate a wall thickness of a removable case for the electronic device.

11. The electronic accessory of claim 1, wherein:

the neck is substantially non-detachable from the body;

the neck surface and the first body surface are substantially immovable relative to each other;

the neck cross-sectional dimension is substantially centered within the first body cross-sectional dimension; and an end portion of the body, comprising the first body surface, is convex relative to an external portion of the electrical connector.

12. The electronic accessory of claim 1, further comprising:

at least one of a microphone, a stereo receiving system, a speaker, or an FM transmitter coupled to the body; and a spacer comprising a spacer thickness and an opening configured to removably accommodate the electrical connector when the opening is concentric with the neck;

wherein:

the electronic device comprises a digital music player; and when the spacer is fully seated with the body, such that the opening is concentric with the neck, the spacer thickness fits between the electronic device and the body of the electronic accessory when the docking end of the electronic device is not covered by a removable case for the electronic device.

13. An electronic accessory configured to couple with an electronic device, the electronic accessory comprising:

a housing comprising:

a body comprising a width, a length, a thickness, and a first body surface; and a neck extending from the body and permanently protruded past the first body surface;

wherein:

at least two opposite sides of the neck are uncradled by the body; and when the electronic accessory is coupled to the electronic device through a docking end of the electronic device:

the neck is located between the body and the electronic device; and at least two opposite sides of the docking end of the electronic device remain uncradled by the body.

14. The electronic accessory of claim 13, wherein:

at least a portion of the first body surface is convex relative to the neck.

15. The electronic accessory of claim 13, wherein:

the first body surface circumscribes the neck around a perimeter of the neck.

16. The electronic accessory of claim 13, wherein:

the neck comprises:

a neck front portion facing a front of the electronic accessory;

a neck rear portion facing a rear of the electronic accessory;

a neck left portion facing a left side of the electronic accessory; or a neck right portion facing a right side of the electronic accessory; and each of the neck front portion, the neck rear portion, the neck left portion, and the neck right portion protrudes past the first body surface.

17. The electronic accessory of claim 13, further comprising:

a spacer comprising an opening configured to be removably coupled around the neck;

wherein:

at least one of a length of the spacer or a length of the housing is less than or approximately equal to a length of the docking end of the electronic device;

when the electronic accessory is fully coupled to the electronic device through the docking end of the electronic device, and the spacer is decoupled from the neck:

a gap exists between the electronic device and at least one of:
the body of the housing; or
the neck of the housing;
and
when the electronic accessory is fully coupled to the electronic device through the docking end of the electronic device, and the opening of the spacer is coupled concentrically with the neck of the housing:
a first surface of the spacer is adjacent and substantially parallel to the first body surface of the electronic accessory; and
a second surface of the spacer is opposite to the first surface and is adjacent and substantially parallel to the docking end of the electronic device.

18. A method for providing an accessory for an electronic device, the method comprising:
providing a housing of the accessory; and
coupling an electrical connector to the housing to permit the accessory to be electrically coupled to a docking end of the electronic device;
wherein:
providing the housing comprises:
providing a body comprising a body cross-sectional dimension and a first body surface; and
providing a neck protruding from the body and past the first body surface, the neck comprising a neck cross-sectional dimension;
the first body surface is non-concave with respect to at least two opposite sides of the neck;
coupling the electrical connector comprises:
locating the electrical connector at least partially within the neck and protruded from a neck surface of the neck;
and
providing the neck comprises:
providing the neck in a permanent external configuration relative to the first body surface.

19. The method of claim 18, wherein:
providing the neck comprises:
providing the first body surface to be substantially non-concave relative to the neck throughout a perimeter of the neck.

20. The method of claim 18, further comprising:
providing a spacer comprising:
an opening configured to removably circumscribe at least a portion of the neck; and
a thickness configured to fit between the first body surface and the docking end of the electronic device when:
the docking end of the electronic device is not covered by a removable case; and
the electrical connector is fully seated with the electronic device.

21. The method of claim 18, further comprising:
providing a packaging configured to at least partially contain the electronic accessory and the spacer;
wherein the packaging comprises at least one of:
one or more instructions to remove the spacer from between the body of the housing and the electronic device when the docking end of the electronic device is covered by a removable case; or
one or more instructions to include the spacer between the body of the housing and the electronic device when the docking end of the electronic device is not covered by the removable case.

22. The method of claim 18, wherein:
providing the housing comprises:
providing the first body surface to be convex with respect to the electrical connector.

23. The method of claim 18, wherein:
the first body surface circumscribes a perimeter of the neck.

* * * * *